US006988679B2

(12) United States Patent
Mattes

(10) Patent No.: US 6,988,679 B2
(45) Date of Patent: Jan. 24, 2006

(54) INJECTION VALVE

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 96 days.

(21) Appl. No.: 10/221,789

(22) PCT Filed: Dec. 22, 2001

(86) PCT No.: PCT/DE01/04917

§ 371 (c)(1),
(2), (4) Date: Jan. 24, 2003

(87) PCT Pub. No.: WO02/057620

PCT Pub. Date: Jul. 25, 2002

(65) Prior Publication Data

US 2004/0074477 A1 Apr. 22, 2004

(30) Foreign Application Priority Data

Jan. 17, 2001 (DE) ..... 101 01 797

(51) Int. Cl.
*F02M 59/00* (2006.01)
*F02M 39/00* (2006.01)
*B05B 1/30* (2006.01)

(52) U.S. Cl. ..... 239/533.2; 239/533.3; 239/533.9; 239/585.1; 239/585.5

(58) Field of Classification Search ..... 239/533.2, 239/533.3, 533.7, 533.8, 533.9, 585.1–585.5, 239/88–93; 251/129.15, 129.21, 127
See application file for complete search history.

(56) References Cited

U.S. PATENT DOCUMENTS

| | | | | | |
|---|---|---|---|---|---|
| 5,779,149 | A | | 7/1998 | Hayes, Jr. | |
| 5,803,361 | A | * | 9/1998 | Horiuchi et al. | 239/88 |
| 5,839,661 | A | * | 11/1998 | Iwanaga | 239/88 |
| 5,890,653 | A | * | 4/1999 | Kelly | 239/5 |
| 5,988,142 | A | * | 11/1999 | Klopfer | 123/446 |
| 6,382,185 | B1 | * | 5/2002 | Mennicken et al. | 123/467 |

FOREIGN PATENT DOCUMENTS

| | | |
|---|---|---|
| DE | 44 34 892 A | 4/1996 |
| WO | WO 97 48900 A | 12/1997 |
| WO | WO 99 02849 A | 1/1999 |
| WO | WO 99 61779 A | 12/1999 |

* cited by examiner

*Primary Examiner*—Davis Hwu
(74) *Attorney, Agent, or Firm*—Ronald E. Greigg

(57) ABSTRACT

An injection valve for an internal combustion engine, including a valve control piston, a valve control chamber with an inlet throttle and an outlet throttle for actuating the valve control piston, a valve control unit, actuated by means of a piezoelectric actuator unit for controlling the valve control chamber, which valve control unit is embodied in valvelike fashion and has a valve closing member cooperating with at least one valve seat. To assure a high closing speed of the valve closing member, the valve closing member and the at least one valve seat are disposed in the valve control chamber.

10 Claims, 2 Drawing Sheets

INJECTION VALVE

CROSS-REFERENCE TO RELATED APPLICATIONS

This application is a 35 USC 371 application of PCT/DE 01/04917, filed on Dec. 22, 2001.

BACKGROUND OF THE INVENTION

1. Field of the Invention

The invention is directed to an improved injection valve for an internal combustion engine.

2. Description of the Prior Art

A valve of the type with which this invention is concerned is known in the industry and is used particularly in conjunction with common rail injection systems for Diesel internal combustion engines. In such an injection valve, a valve control piston is at least partly surrounded by a chamber that contains fuel and communicates with a high-pressure connection. One end of the valve control piston is embodied in the form of a needle and cooperates with a correspondingly embodied valve seat. Depending on the position of the valve control piston, it is thus possible, via an opening located in the chamber surrounding the valve control chamber and leading to a combustion chamber of the engine, to control the fuel injection into the combustion chamber. The position of the valve control piston is defined via the pressure prevailing in the valve control chamber. The pressure prevailing in the valve control chamber is controlled in turn by means of the valve control unit, which for actuation can be operatively connected for instance to a piezoelectric actuator unit.

In the injection valve of the type defined above, in which the valve control unit itself is embodied in valvelike fashion and has a valve closing member which cooperates with a valve seat, fuel is injected into the combustion chamber when the valve closing member is in the open position, and the pressure prevailing in the valve control chamber is thus reduced, as a result of which the valve control piston uncovers the opening leading to the combustion chamber. Conversely, the valve control piston closes the opening leading to the combustion chamber when the valve closing member rests by positive engagement on the valve seat and the so-called common rail pressure is established in the valve control chamber.

The valve control chamber itself has an inlet throttle, disposed in an inlet conduit, and by way of this throttle fuel can be carried into the valve control chamber. The inlet throttle provides that when the valve closing member opens, a pressure equalization does not occur abruptly in the valve control chamber; instead, the pressure equalization comes about only after the valve closing member has closed. Otherwise, the valve control piston could not be moved by way of the pressure prevailing in the valve control chamber. Moreover, the valve control chamber of the injection valve in the prior art has an outlet throttle, disposed in an outlet conduit, that leads to a valve chamber in which the valve closing member is disposed. This outlet throttle serves to provide that the fuel carried away by way of it and returned to a fuel tank via a return line will not flow at the common rail pressure into the return line, because that would result in excessive leakage losses.

In the known injection valve, the valve closing member is actuated by means of an actuating piston, which cooperates via a hydraulic booster with an adjusting piston actuated by means of the actuator. Particularly in a valve closing member actuated by means of a piezoelectric actuator, the closing speed of the piezoelectric actuator is considerably less than its opening speed, since the hydraulic booster is unable to return the valve closing member. Instead, as a rule this return is effected via the fuel pressure prevailing in the outlet throttle, in conjunction with a restoring spring. However, the restoring speed is relatively slight.

SUMMARY OF THE INVENTION

The proposed injection valve in which the valve closing member and the at least one valve seat are disposed in the valve control chamber, has the advantage over the prior art that the valve closing member is exposed virtually to the common rail pressure, that is, to a very high pressure of up to 1.5 kbar, which brings about a very fast closure of the valve closing member. This high restoring force, compared to the prior art described above, leads to a more-direct coupling between the electrically controlled unit of the injection valve, on the one hand, and the dynamics of the nozzle needle and the hydraulics of the injection valve, on the other, which in turn means flatter characteristic quantity curves of the injection valve, or a reduction in the tolerances in the injection quantity. Also in comparison to the prior art, the construction according to the invention reduces the valve vibration when the valve opens, because a graduated exertion of force on the switching valve is brought about, and the restoring force is pressure-dependent.

The injection valve of the invention, compared to the prior art, also brings about a considerable reduction in variation from one example of an injection valve to another; that is, for the same tolerances in manufacture, a higher number of usable parts can be produced.

In a preferred embodiment of the invention, the valve control chamber includes at least two and preferably three chambers, each communicating with one another via a respective conduit. These chambers, which are preferably disposed coaxially to the valve control piston, are advantageous designed in such a way that the valve control piston protrudes into a first one of the chambers, and a conduit with the inlet throttle also discharges into it; the valve closing member is disposed in a subsequent chamber; and a leak fuel conduit, in which the outlet throttle is disposed and which discharges into a return line leading to a supply tank, branches off from a third chamber. This design is structurally especially simple to produce and is therefore expedient.

To reinforce the restoration process, a restoring spring can engage the valve closing member.

Further advantages and advantageous features of the subject of the invention can be learned from the description, drawing and claims.

BRIEF DESCRIPTION OF THE DRAWINGS

One exemplary embodiment of the injection valve of the invention is explained in further detail in the ensuing description with reference to the drawings, in which.

DESCRIPTION OF THE PREFERRED EMBODIMENT

Figure 1:
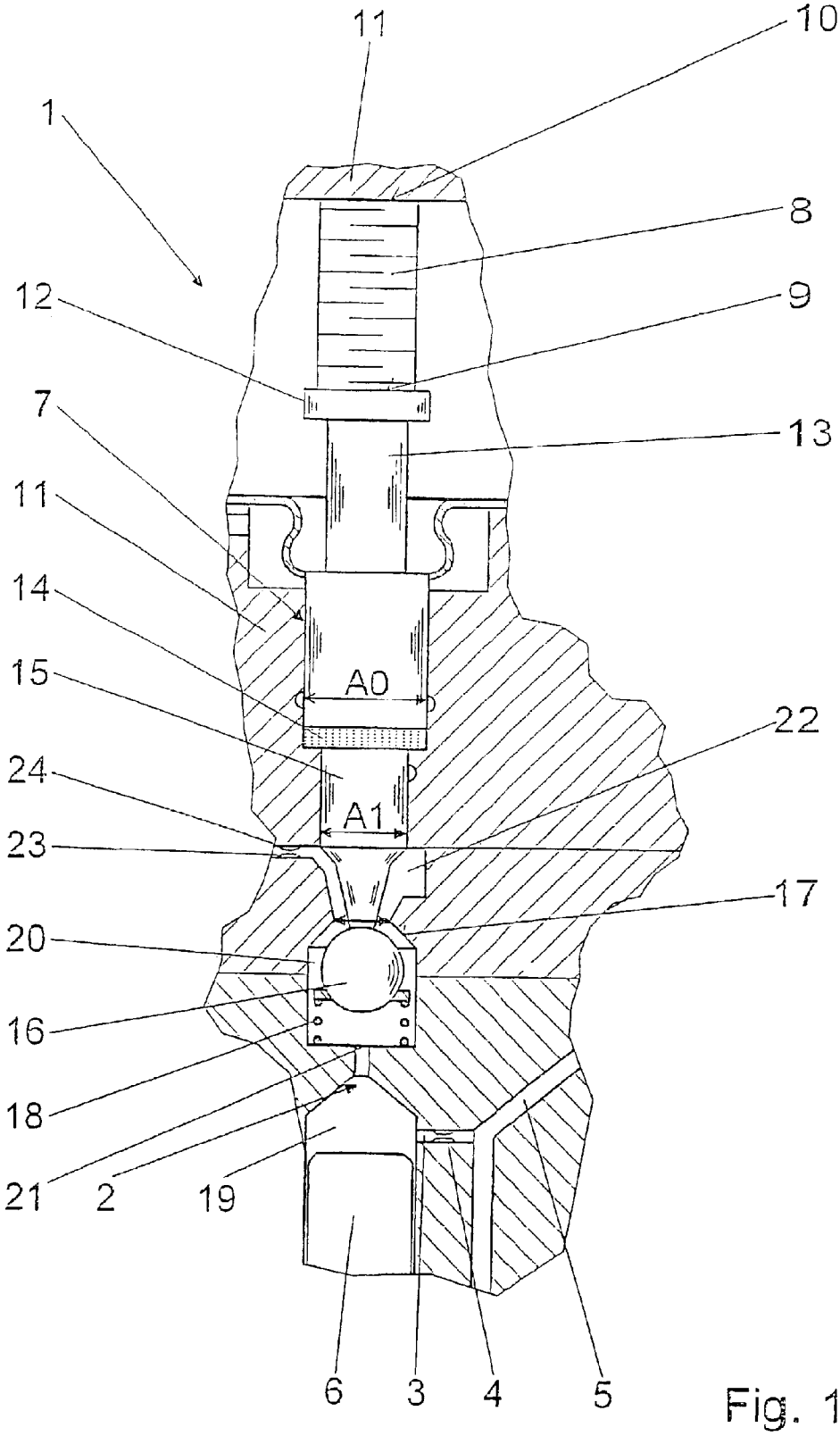
FIG. 1, a region relevant to the invention of an injection valve, in longitudinal section.

The exemplary embodiment shown in FIG. 1 is a fuel injection valve 1 for installation in an internal combustion engine of a motor vehicle. In the present version, the injection valve 1 is embodied as a common rail injector, for injecting Diesel fuel in particular. The fuel injection event is controlled by way of the pressure level in a valve control chamber 2, which communicates via an inlet conduit 3, in which an inlet throttle 4 is disposed, with a fuel supply conduit 5. The fuel supply conduit 5 communicates with a high-pressure reservoir or so-called common rail that is common to a plurality of injection valves. The fuel carried in the fuel supply conduit 5 can thus be at a pressure of up to 1.5 kbar.

A valve piston 6 shown only in fragmentary form in FIG. 1 is disposed in the valve control chamber 2 and acts on a nozzle needle in such a way that the nozzle needle closes or opens injection openings into a combustion chamber.

For adjusting an injection onset, injection duration and injection quantity via force conditions in the fuel injection valve 1, a valve member 7 is triggered, via an actuator unit, embodied in this case as a piezoelectric actuator 8, which is disposed on the side of the valve member 7 remote from the valve control chamber 2 and from the combustion chamber.

The piezoelectric actuator 8 is constructed of multiple layers in the usual way, and it has an actuator head 9 on its side toward the valve member 7 and an actuator foot 10 on its side remote from the valve member 7, the foot being braced on one wall of a valve body 11. Via a bearing plate 12, the actuator head 9 engages a first piston 13, which is known as an adjusting piston. The valve member 7 is disposed axially displaceably in a longitudinal bore of the valve body 11 and includes, in addition to the adjusting piston 13, a second piston 15 or so-called actuating piston, which actuates a valve closing member 16.

The adjusting piston 13 and the actuating piston 15 are coupled to one another via a hydraulic booster, which is embodied as a hydraulic chamber 14 and which transmits the axial deflection of the piezoelectric actuator 8. The diameter A1 of the actuating piston 15 is less than the diameter A0 of the adjusting piston 13. The hydraulic boost thus defined causes the actuating piston 15 to execute a stroke that is increased by the boosting ratio of the piston diameters when the adjusting piston 13 of larger diameter is moved a certain distance by the piezoelectric actuator 8.

The valve closing member 16 cooperates with a valve seat 17 and is urged in the direction of the piezoelectric actuator 8, that is, the closing direction, by means of a restoring spring 18.

The valve control chamber 2 has three chambers, namely a first chamber 19, into which the valve control piston 6 protrudes and into which the inlet conduit 3 communicating with the fuel supply line 5 and provided with the inlet throttle 4, discharges; a chamber embodied as a valve chamber 20, in which the valve closing member 16, the restoring spring 18 and the valve seat 17 are disposed, and which communicates with the first chamber 19 via a conduit 21; and a so-called outlet chamber 22, which when the valve closing member 16 is open communicates with the valve chamber 20 and from which a leak fuel conduit 23 branches off, in which conduit in turn an outlet throttle 24 is disposed.

Because of this design, when the valve closing member 16 is open, essentially the same flow pressure prevails in all three regions 19, 20 and 22 of the valve control chamber 2, and thus the pressure acting on the valve closing member 16 via the inlet throttle 4 is exerted in the direction of the valve seat 17.

The fuel injection valve of FIG. 1 functions as described below.

In the closed state of the fuel injection valve 1, that is, when no voltage is applied to the piezoelectric actuator 8, the valve closing member 16, embodied in the shape of a ball, is located on the valve seat 17 assigned to it. In this position, the valve closing member 16 is pressed into the valve seat 17, embodied here as a ball seat, both by means of the pressure exerted on the valve control chamber 2 via the inlet conduit 3 and by means of the force of the spring 18. The valve closing member 17 is thus in the blocking position then.

If the injection valve 1 is to be opened, that is, if the injection nozzle, not shown here, that is closed by the valve control piston 6 is to be opened, then an electrical voltage is applied to the piezoelectric actuator 8, whereupon the piezoelectric actuator abruptly expands in the axial direction, that is, in the direction of the adjusting piston 13. As a result, the latter piston is moved in the direction of the actuating piston 15, whereupon a so-called opening pressure builds up in the hydraulic chamber 18, by means of which pressure in turn the actuating piston 15 is displaced in the direction of the valve control piston 6. Together with the actuating piston 15, the valve closing member 16 connected to it is also moved in the direction of the valve control piston 6, as a result of which the transition between the valve chamber 20 and the outlet chamber 22 is opened. In this position of the valve closing member 16, the fuel in the chamber 2 and in the valve chamber 20 flows into the outlet chamber 22, and from there flows away via the leak fuel conduit 23 and the outlet throttle 24 located in it. The valve control chamber 2 and in particular the sub-chamber 19 of the valve control chamber 2 are relieved as a result, so that the pressure in the valve control chamber drops, and the valve control piston 6 is displaced in the direction of the valve member 7. As a result, the opening, not visible in FIG. 1, leading to the combustion chamber of the engine is uncovered, and fuel that is at high pressure and is brought via the fuel supply conduit 5 is injected into the combustion chamber.

If the voltage applied to the piezoelectric actuator 8 is then interrupted, the adjusting piston 13 is returned in the direction of the piezoelectric actuator 8; as a result, the pressure prevailing in the hydraulic chamber 14 is reduced and the valve closing member 16 and thus the actuating piston 15 are also displaced in the direction of the piezoelectric actuator 8, by means of the pressure exerted on the valve control chamber 2 via the inlet throttle 4, until the valve closing member 16 comes to rest in the valve seat 17. Since in the injection valve 1 of the invention, a very high pressure is operative via the inlet throttle 4, the closing event of the valve closing member takes place extraordinarily quickly. The common rail pressure that then builds up anew in the chamber 19 and the valve chamber 20 moves the valve control piston 6 back into its closing position.

Figure 2:
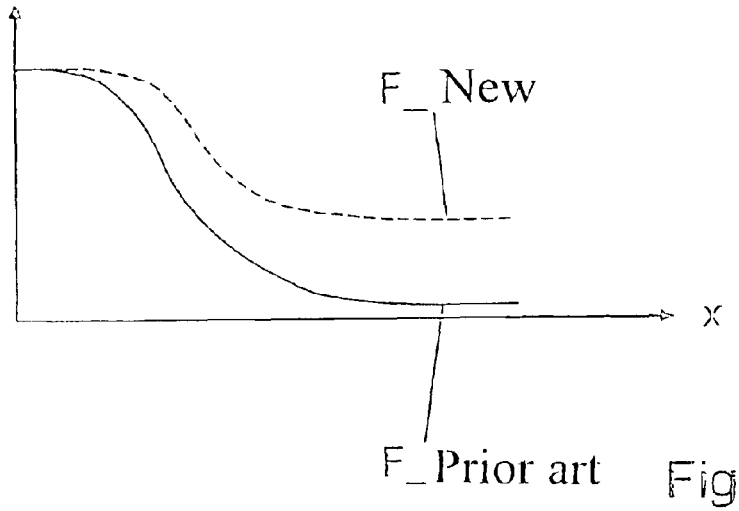
FIG. 2, a force/travel graph, in which the injection valve of the invention is compared with an injection valve of the prior art.
Figure 3:
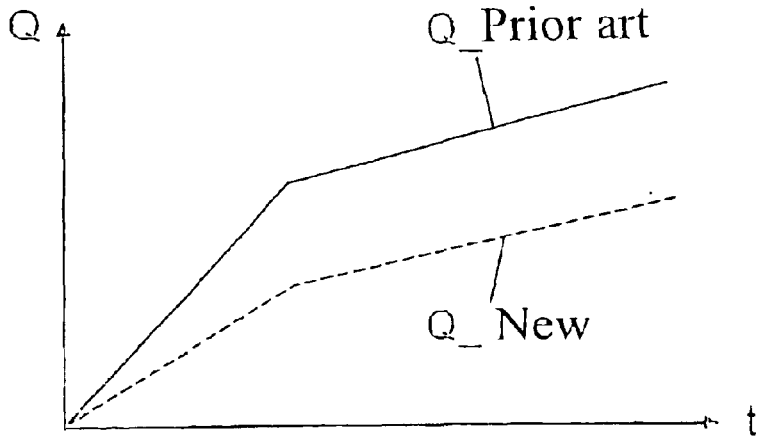
FIG. 3, the quantity performance graph of the injection valve of the invention and the quantity performance graph of an injection valve of the prior art, in comparison.

In FIGS. 2 and 3, differences between the injection valve of the invention and an injection valve of the prior art are shown as examples.

In FIG. 2, it can be seen from a line that over the travel x symbolizes the force curve F-new for an injection valve of the invention and a line symbolizing the force curve F-prior art for a conventional injection valve, that in the injection valve of the invention, moving the valve closing member a certain travel distance requires a greater adjusting force F than in the valve of the prior art.

FIG. 3, in which the flow quantity Q through the injection nozzle is plotted over the duration of triggering of the piezoelectric actuator over the time t with a line Q-new for an injection valve of the invention and a line Q-prior art for a conventional injection valve, it can be seen that because in the injection valve of the invention the hydraulics are more directly coupled to the electrical performance of the piezoelectric actuator 8, a flattening of the characteristic quantity curve Q (t) of the injection valve is achieved, since the valve closing member 16 reaches its blocking position significantly faster than in an injection valve of the prior art, in which the valve closing member is located not in the valve control chamber but in terms of the flow downstream of the valve control chamber, after the outlet throttle.

The foregoing relates to preferred embodiments of the invention, it being understood that other variants and embodiments thereof are possible within the spirit and scope of the invention, the latter being defined by the appended claims.

I claim:

1. In an injection valve for an internal combustion engine, comprising a valve control piston (6), a valve control chamber (2) for actuating the valve control piston (6) into which an inlet conduit (3), provided with an inlet throttle (4), communicates with a fuel supply line (5) and from which a leak fuel conduit (23) branches off, the leak fuel conduit (23) being provided with an outlet throttle (24) therein, a valve control unit actuated by means of a piezoelectric actuator unit (8) for controlling the valve control chamber (2), the valve control unit being embodied in valvelike fashion and having a valve closing member (16) cooperating with at least one valve seat (17), and wherein the valve closing member (16) and the at least one valve seat (17) are disposed in the valve control chamber (2).

2. The injection valve of claim 1 wherein the valve control chamber (2) further comprises at least two and preferably three chambers (19, 20, 22), each communicating with one another via a respective conduit.

3. The injection valve of claim 2 wherein the chambers (19, 20, 22) are disposed coaxially with the valve control piston (6).

4. The injection valve of claim 3 wherein the valve control chamber (2) includes three chambers (19, 20, 22), the valve control piston (6) protrudes into a first chamber (19), and the inlet conduit (3) discharges with the inlet throttle (4) into that chamber; wherein the valve closing member (16) is disposed in a second chamber (20) adjoining the first chamber (19); and wherein the leak fuel conduit (23), in which the outlet throttle (24) is disposed, branches off from a third chamber (22) adjoining the second chamber (20).

5. The injection valve of claim 4 further comprising a restoring spring (18) engaging the valve closing member (16).

6. The injection valve of claim 3 further comprising a restoring spring (18) engaging the valve closing member (16).

7. The injection valve of claim 2 wherein the valve control chamber (2) includes three chambers (19, 20, 22), the valve control piston (6) protrudes into a first chamber (19), and the in let conduit (3) discharges with the inlet throttle (4) into that chamber; wherein the valve closing member (16) is disposed in a second chamber (20) adjoining the first chamber (19); and wherein the leak fuel conduit (23), in which the outlet throttle (24) is disposed, branches off from a third chamber (22) adjoining the second chamber (20).

8. The injection valve of claim 7 further comprising a restoring spring (18) engaging the valve closing member (16).

9. The injection valve of claim 2 further comprising a restoring spring (18) engaging the valve closing member (16).

10. The injection valve of claim 1 further comprising a restoring spring (18) engaging the valve closing member (16).

* * * * *